United States Patent [19]

Nozawa et al.

[11] 4,127,986

[45] Dec. 5, 1978

[54] PENDULUM CLOCK MECHANISM

[75] Inventors: Kazutoshi Nozawa; Yasue Ashibe; Hatsuo Aruga, all of Kamiina; Kunio Tatsuzawa, Ina, all of Japan

[73] Assignee: Rhythm Watch Co., Ltd., Tokyo, Japan

[21] Appl. No.: 755,549

[22] Filed: Dec. 30, 1976

[30] Foreign Application Priority Data

May 1, 1976 [JP] Japan ..... 51-50374

[51] Int. Cl.[2] ..... G04B 17/16

[52] U.S. Cl. ..... 58/134; 58/123; 58/129; 58/131; 58/132; 58/133; 58/135

[58] Field of Search ..... 58/123, 129, 131–135

[56] References Cited

U.S. PATENT DOCUMENTS

| | | | |
|---|---|---|---|
| 629,370 | 7/1899 | Keeler | 58/134 |
| 654,726 | 7/1900 | Getty | 58/129 |
| 933,381 | 9/1909 | Miller | 58/134 |
| 945,581 | 1/1910 | Ogawa | 58/134 |
| 3,171,244 | 3/1965 | Koplar et al. | 58/123 X |
| 3,411,288 | 11/1968 | Koplar et al. | 58/129 X |

FOREIGN PATENT DOCUMENTS

| | | | |
|---|---|---|---|
| 710756 | 6/1954 | United Kingdom | 58/134 |
| 732694 | 6/1955 | United Kingdom | 58/134 |

*Primary Examiner*—Ulysses Weldon

*Attorney, Agent, or Firm*—Koda and Androlia

[57] ABSTRACT

A pendulum clock mechanism including a conventional escapement may be coupled to a conventional pendulum bob by means of a rotatable lever such that the oscillations of the escapement are regular and periodic regardless of misalignments of the clock mechanism with the vertical as defined by gravity. The escapement is driven by a lever which is rotatably fixed to the arm of the pendulum. The pendulum is supported from an independent pivot. The lever and pendulum arm are frictionally coupled such that when the equilibrium position of the pendulum arm is offset from the designed equilibrium position of the clock mechanism, the lever is automatically rotated such that the escapement is still driven about its designed equilibrium position.

2 Claims, 6 Drawing Figures

PENDULUM CLOCK MECHANISM

BACKGROUND OF THE INVENTION

1. Field of the Invention

The present invention relates to the field of pendulum driven clocks and in particular, relates to mechanisms which include means for self-adjusting the driving member of the escapement in response to misalignments of the clock mechanism with respect to the vertical.

2. Description of the Prior Art

As is well known in pendulum clocks, the periodic oscillation of the pendulum bob is used as the time keeping or regulating device. Such clocks have proven to be very efficient, reliable, simple and accurate when used as stationary wall clocks. Thus, such clocks, despite the age of their basic design are still widely accepted and employed. However, pendulum clocks still suffer from at least one major shortcoming. In order to obtain accurate and reliable time keeping operation, the clock must be installed and aligned along a designed orientation with respect to the vertical as defined by gravity. This condition arises for the most part from the operational characteristics of the escapement mechanism. For example, in conventional pendulum clocks, the relative position of the pendulum bob or pendulum arm and the anchor of the escapement mechanism are designed to assume a neutral or equilibrium position when the designed vertical of the escapement mechanism is aligned along the vertical as defined by gravity. The escapement mechanism operates in an optimum fashion when the pendulum clock is installed such that the designed vertical lies parallel to the gravitational vertical. When such an alignment occurs, the escapement mechanism operates with a minimum amount of error and a maximum degree of reliability. In this case, the anchor or ratchet of the escape wheel is in its proper escapement position.

However, if a conventional pendulum clock is installed in a position which is misaligned with the gravitational vertical, the equilibrium position of the pendulum arm or bob is aligned along an axis which is nonparallel to the designed vertical of the escapement mechanism. The motion of the pendulum bob in this case causes the anchor to oscillate in a nonsymmetrical fashion. In this improper positioning, the anchor will execute a periodic oscillation with respect to its corresponding escape wheel with a perturbation which is directly proportional to the angle of inclination between the designed vertical and the gravitational vertical. This perturbation is manifested as a change in the degree of engagement between the pallet pins of the anchor and the escape wheel. This perturbation, or improper engagement, is known as anchor sideswing and is a chief factor in time keeping inaccuracy in pendulum regulated clocks. In the extreme case, the improper engagement between the anchor and escape wheel may cause the escape mechanism to fail and cease keeping time. Understandably, such an extreme case results in a complete and functional failure of the pendulum clock.

Furthermore, another defect in conventional pendulum clocks is the vulnerability of the pallet pins to relatively mild shocks. Any undue stress exerted upon the pallet pins may either bend or break one or more of the pallet pins when the pallet pins strike the escape wheel with excessive force. Such an event may occur either due to anchor sideswing or when the pendulum is given a strong pull in order to start the periodic motions of the clock. Bending or breaking of the pallet pins may also be caused by erratic oscillation of the pendulum due to vibration or impulsive changes in speed when the clock is shipped or moved.

Therefore, what is needed is an invention which overcomes each of the prior art shortcomings, to wit, a pendulum clock mechanism which will accurately keep time even though the designed vertical is misaligned with the gravitational vertical; and which damage to the pallet pins is substantially prevented by reducing the stress or shock applied to the pallet pins; and which will be automatically self-adjusting to prevent anchor sideswing and damage during movement, starting, or shipment.

BRIEF SUMMARY OF THE INVENTION

The present invention is a clock mechanism comprising a pendulum; an escapement for controlling the speed and regularity of movement of the pendulum; and means for coupling the escapement and pendulum and for driving the escapement in a symmetric, periodic movement regardless of the disposition of the pendulum and escapement with respect to the vertical. By virtue of the above combination of elements, a clock mechanism is devised whereby the escapement executes accurate time keeping motions without substantial dependence on the alignment of the clock mechanism with respect to the vertical as defined by gravity. The clock mechanism makes such an adjustment by automatically compensating for misalignments between the design vertical and the gravitational vertical.

In particular, the clock mechanism of the present invention includes within the means for coupling the escapement and pendulum, a lever which is rotatably coupled to the pendulum and to the escapement. The lever is rotable with respect to the pendulum whenever a torque greater than a predetermined magnitude is exerted upon the lever. Thus, when the pendulum is misaligned from the designed vertical or when the pendulum is subjected to an impulsive force, the torque exceeds the predetermined magnitude at some point during the oscillation of the pendulum such that the degree of stress to the pallet pins is substantially reduced and such that the escapement is driven about its designed equilibrium position.

These, and other advantages, of the present invention as well as its specific embodiments may be better understood by viewing the following detailed description of the preferred embodiments in light of the following figures.

DETAILED DESCRIPTION OF THE PREFERRED EMBODIMENTS

The present invention is an improved pendulum clock mechanism which contains an automatic adjusting device which self-adjusts the position of the anchors of an escapement mechanism such that the anchor will be in an optimum or designed position during the oscillation of the pendulum regardless of the exact alignment of the clock mechanism with respect to the gravitational vertical. The present invention includes a pendulum clock mechanism which includes an escape wheel with escape teeth disposed on a circumference, an anchor which pivots about a pallet arbor and which has at least two pallet pins which engage the escape wheel, a pendulum bob which acts as an oscillating time standard for the clock, and coupling parts, described below, which connect the pendulum with an anchor crutch fastened to the pallet arbor. Such coupling parts include a slip or lever mechanism in at least one position. As a result of the operation of such lever, excess torque acting upon the anchor due to improper installation of the pendulum clock, or due to any other reason, is used to cause the lever to slip, as designed, thereby automatically adjusting the movement of the anchor so that the anchor moves into its proper designed position. Accordingly, the anchor will automatically slip into its proper designed position and will oscillate about the designed equilibrium position even when the pendulum clock has been installed in an improper position with respect to gravitational vertical. Furthermore, damage to the pallet pins is substantially prevented by slippage of the lever whenever a shock is applied to the pallet pins. In the present invention, the accuracy of the clock is greatly simplified by virtue of the fact that a correct escapement position is obtained even when the pendulum clock is not installed in a proper position. Furthermore, in the present invention, adjustment for anchor sideswing is rendered unnecessary thereby simplifying the assembly and installation of an accurate pendulum timepiece. Finally, the likelihood of damage to the anchor during shipment of the clock is substantially reduced.

Figure 1:
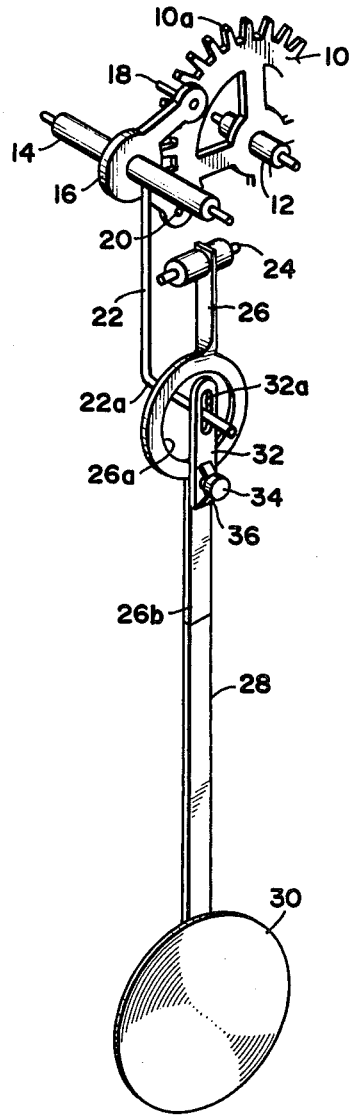
FIG. 1 is a diagrammatic view of many of the material elements of the present invention showing the coupling between the pendulum and escapement.
Figure 2:
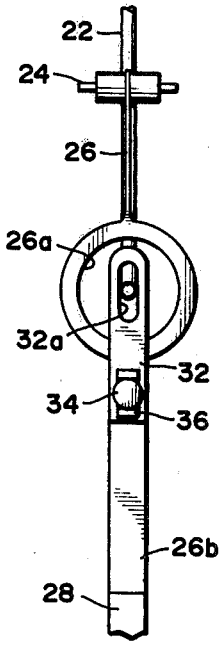
FIG. 2 is a front view of that portion of the present invention showing the coupling between the pendulum and escapement according to the embodiment of FIG. 1.
Figure 3:
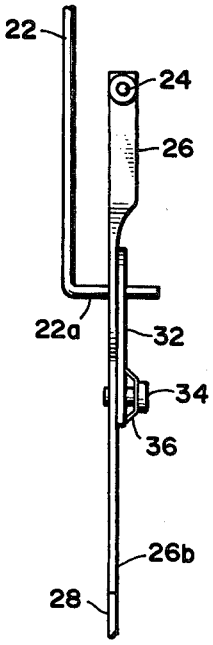
FIG. 3 is a side view of the same portion of the present invention as shown in FIG. 2.

The operation of the present invention may be better understood by viewing FIGS. 1–3. In particular, FIG. 1 shows an escape wheel 10 supported by an escape wheel arbor 12. Escape wheel 10 has a plurality of escape teeth **10*a* disposed about its circumference. It is to be understood that a conventional clock gear train may be driven by the regulated motion of escape wheel 10 and escape wheel arbor 12 according to principles well known to the art. For example, a pinion gear, not shown, may be coupled to wheel arbor 12 and suitably engaged with a clock gear train and indication means. A pallet arbor 14 is disposed in a clock housing such that it is free to rotate in the vicinity or proximity of escape wheel 10. An anchor 16 is disposed about pallet arbor 14 so that it is free to pivot thereabout. Two pallets, comprised of pallet pins 18 and 20 are perpendicularly disposed on anchor 16, one pallet pin at each end of the symmetrically shaped anchor, so that pallet pins 18 and 20 engage escape teeth 10*a* of escape wheel 10 in a manner well known to the art such that escape wheel 10 is regulated by the oscillatory motion of anchor 16. Clearly, anchor 16 has a designed equilibrium position such that the angle of rotation of anchor 16 about pallet arbor 14 is symmetric. Should anchor 16, for any reason oscillate around a position offset from the designed equilibrium position, pallet pins 18 and 20 will execute different motions with respect to escape wheel 10 and will not symmetrically engage escape teeth 10*a*. In the extreme case, one of the pallet pins may be driven with such force against escape wheel 10** that the pallet pin may be bent, broken or the escapement may be jammed.

An anchor crutch or swing rod 22 is rigidly coupled to pallet arbor 14. In the embodiment of FIG. 1, the other end of anchor crutch 22 is bent into an "L" shape such that it may engage the pendulum swing mechanism described below. The pendulum swing mechanism provides a means for coupling the escapement and pendulum and for driving the escapement in a symmetric, periodic movement regardless of the disposition of the pendulum and escapement with respect to the gravitational vertical. The pendulum swing mechanism includes a pendulum suspension post or pivot point 24 which is fixed relative to the escapement. Typically, suspension post 24 is fastened to the movement case of the clock. One end of a swing member 26 is fastened or coupled to pendulum suspension post 24. Thus, post 24 supports the entire pendulum mechanism and removes this stress from the escapement. In the embodiment illustrated in FIGS. 1–6, swing member 26 is formed as a resilient member such as from a leaf spring. Swing member 26 may have a curved portion formed as a ring **26*a* with an open center. Swing member 26 may continue downward from ring 26*a* to form a lower arm 26*b*. A pendulum bob 30, which constitutes an oscillating time standard for the clock, is coupled to a pendulum rod or arm 28 in such a manner that the center of gravity of pendulum bob 30 may be adjusted along the gravitational vertical through suspension post or pivot point 24. However, it must be understood that it is within the scope of the present invention that pendulum arm 28 may be directly coupled to ring 26*a* and lower arm 26*b*** omitted.

A lever 32 is slideably or rotatably coupled to swing member 26, or may, in the appropriate embodiment, be coupled to pendulum arm 28. In the following, it will be assumed that swing member 26 includes a lower arm **26*b* to which lever 32 is coupled. However, the scope of the present invention is to expressly include all equivalent attachments between pendulum bob 30 and pivot point or suspension post 24. The upper end of lever 32 extends into the central opening of ring portion 26*a*. An opening or slot 32*a* is drilled or formed into the upper portion of lever 32. The "L" shaped end 22*a* of anchor crutch 22 is disposed through slot or opening 32*a*. Thus, by this means, the escapement is coupled to the pendulum. Lever 32 and swing member 26 are coupled by a pivot pin 34 so that some play or rotation is possible between lever 32 and swing member 26. In the embodiment illustrated, swing member 26 and lever 32 are frictionally coupled and are held together by means of a compressive force by a slip spring 36 which is mounted between pivot pin 34 and lever 32. Slip spring 36 may be comprised of a leaf spring which is mounted in a prescribed condition of compression such that the torque required to move swing member 26 with respect to lever 32 is maintained at a predetermined magnitude. Many other equivalent modes and means of coupling between lever 32 and swing member 26 may be employed without departing from the scope of the present invention. All that is required is that lever 32 shall be permitted to make a rotational movement with respect to swing member 26 when the torque applied by anchor crutch 22 on lever 32** exceeds a certain level.

In the embodiment illustrated in the figures, swing member 26 is made from leaf spring material. Thus, the oscillation of pendulum bob 30 is made possible by the resiliency of this leaf spring material. It is to be noted that by use of a leaf spring material in the embodiment as illustrated in FIGS. 1–3, the direction of movement of pendulum bob 30 is substantially constrained and limited to the direction in which the resilient swing member 26 bends most easily. Thus, pendulum bob 30 is confined to oscillations within the plane of the drawing as shown in FIG. 2 and perpendicular to the plane of the drawing as shown in FIG. 3. It is to be understood that it is also possible to make swing member 26 itself from a rigid metal plate and to attach a separate leaf spring to the appropriate portion of swing member 26. In the embodiment of FIG. 1, pendulum bob 30 is suspended from pendulum suspension post 24 such that no excessive load is placed upon anchor 16. Furthermore, in the presently illustrated embodiment, the coupling parts, including swing member 26, pendulum rod or arm 28, and lever 32 are combined to form a frictional slip mechanism. It can be appreciated that as a result of this mechanism, when the torque applied to anchor 16 exceeds the magnitude required for proper oscillatory or escape action, that this excessive torque will be absorbed in a larger part by the action of the slip mechanism. The frictional slip torque between lever 32 and swing member 26 is regulated so that it is slightly greater than the rotational torque applied during the normal oscillatory or escape action of anchor 16 and escape wheel 10.

Figure 4:
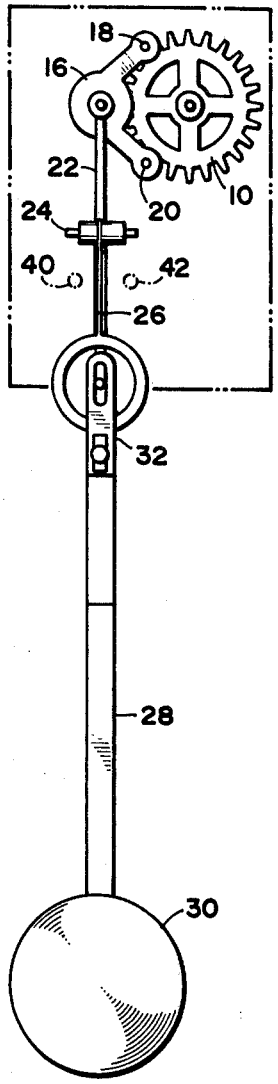
FIG. 4 illustrates the operation of the present invention when the clock mechanism has its designed vertical aligned substantially along the gravitational vertical.

The operation of the present invention may now be understood as follows. FIG. 4 illustrates a pendulum clock incorporating the illustrated embodiment of the present invention when the pendulum clock has been installed in a proper position having the design vertical aligned with the gravitational vertical. In this case, both pendulum bob 30 and anchor 16 swing in equal distance in both directions about the designed equilibrium position. Accordingly, no improper torque is applied to the slip mechanism of the coupling parts and no slipping action occurs in the slip mechanism.

Figure 5:
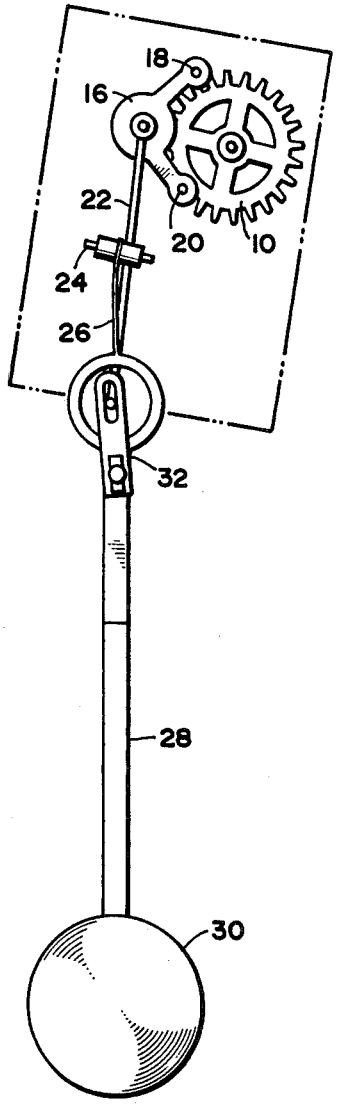
FIG. 5 illustrates the view of FIG. 4 when the clock mechanism has been rotated in a clockwise fashion with respect to the gravitational vertical.
Figure 6:
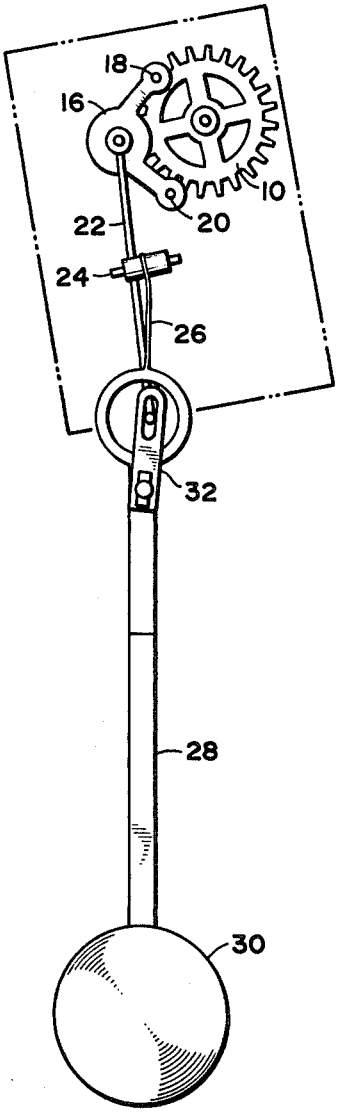
FIG. 6 illustrates the operation of the present invention when the clock mechanism of FIG. 4 has been rotated in a counterclockwise direction with respect to the gravitational vertical.

FIG. 5 illustrates a pendulum clock incorporating the illustrated embodiment of the present invention when the pendulum clock has been installed in a position which is inclined in a clockwise direction with respect to the gravitational vertical. Furthermore, FIG. 6 illustrates a pendulum clock which has been installed in a position which is inclined in the counterclockwise direction from the gravitational vertical. In both these improper installations, an automatic adjusting action, which will adjust the perturbation and oscillation displacements, takes place in the coupling parts between pendulum bob 30 and anchor 16. This self-adjusting action makes it possible to constantly maintain a uniform reciprocating or oscillatory motion of pendulum bob 30 and anchor 16 with respect to the designed vertical or equilibrium of escapement, and in particular, anchor 16.

In other words, even in the improper installations as shown in FIGS. 5 and 6, pendulum bob 30 is itself constantly in a state of uniform oscillatory or reciprocating motion with respect to the gravitational vertical. The motion of pendulum bob 30 is transmitted to anchor 16 via pendulum rod 28, swing member 26 and lever 32. However, since anchor 16 is itself installed in a misaligned or inclined position when the clock mechanism is improperly installed, the proper reciprocating motion of pendulum bob 30 with respect to the gravitational vertical will attempt to exert a greater torque upon anchor 16 during one excursion of this oscillation as compared to the opposing excursion. According to the present invention, the magnitude of slip torque between swing member 26 and lever 32 is designed and regulated such that it is slightly less than this greater or biased torque. In the position of installation, shown in FIGS. 5 and 6, a bias torque, which will be greater than the slip torque, is applied across swing member 26 and lever 32. Accordingly, lever 32 will be rotated relative to swing member 26 until it is in a position in which the proper escape or oscillatory actions are executed by anchor 16 under the conditions as dictated by the improper installation of the pendulum clock. When the angle of improper installation is large, the oscillation of pendulum bob 30 may also cause one of pallet pins 18 and 20 of anchor 16 to forcefully strike against the bottom of one of escape teeth **10*a* on escape wheel 10. In such a case, swing member 26 and lever 32 will, as described above, produce a slipping action so that the position of anchor 16 is automatically adjusted to a proper position in accordance with the direction and magnitude of the excessive or bias torque applied to anchor 16. When swing member 26 and lever 32 are thus rotated into proper positions, the torque will drop to the normal escape torque and the normal escape or oscillatory action will begin. This corrective action is completed within the time span required for several oscillations of the pendelum according to the degree of excess torque applied to anchor 16**. Thus, the error in time keeping which occurs during this period will be extremely small.

Thus, in this invention, even when the clock is installed in an inclined angle, an automatic adjusting action will take place as soon as the clock mechanism is started into motion. This causes the position of anchor 16 to be corrected such that anchor 16 is in a proper designed position for escape action. Accordingly, normal, regular and uniform engagement between pallet pins 18 and 20 of anchor 16 and escape wheel 10 will be achieved so that the time error due to stoppage or irregularity of the oscillation of pendulum bob 30 is substantially prevented.

The embodiment illustrated contains a slip mechanism which depends upon a slip spring 36. However, this slip mechanism could also employ a coil spring or a frictional plate made of synthetic resin or any other well known or yet to be discovered equivalent in the art. In this invention, the frictional slip torque of the slip mechanism may be fixed according to well known design principles. Generally, where the weight of the pendulum bob is 50 grams and the angle of swing of the pendulum is offset 5 degrees, a range of 8 to 30 gram centimeters is suitable and a range of 16 to 20 gram centimeters is optimal for the magnitude of the slip torque which will initiate the slip action. Furthermore, by installing limit stops 40 and 42 in the vicinity of swing member 26 as shown in FIG. 4, in order to prevent extreme oscillatory motion which exceeds the normal range of movement of swing member 26, it becomes possible to regulate the angle of engagement between swing member 26 and lever 32 by utilizing the restraining force of pins 40 and 42 upon swing member 26 when the clock is in an improperly inclined position. In other words, the strain may be removed from anchor 16 and pallet pins 18 and 20 and transferred instead to limit stops 40 and 42 during the automatic adjustment process.

Clearly the present invention is characterized by at least the following features. When the pendulum clock is installed in a position in which it is misaligned from the gravitational vertical, a slip mechanism, which is incorporated in the coupling parts between the pendulum bob and the anchor crutch, automatically causes a slipping action to occur, thereby creating a correction which results in a properly compensated position for the escapement, and in particular, the anchor. Thus, the anchor and escape wheel will be in a proper position for uniform oscillatory engagement. This feature makes it possible to obtain a pendulum clock which is substantially free from clock stoppage and time indication errors due to this and similar types of improper installment. It is to be expressly understood that many modifications and alterations may be made in the elements illustrated and in the way in which the elements are combined without substantially departing from the scope and spirit of the present invention. The embodiment illustrated in FIGS. 1–6 have been shown only for the purposes of clarity and illustration and do not limit the scope of the claims.

I claim:

1. A clock mechanism comprising:

a pendulum;

an escape wheel having plurality of escape teeth disposed on the periphery of said escape wheel;

an anchor coupled to a rotatable pallet arbor and having two symmetrical pallet pins engageable with said escape wheel;

a swing rod coupled to said arbor;

a resilient swing member coupled to a pivot point at a first end and to said pendulum at a second end;

a pivot pin provided on said swing member;

a lever rotatably provided on said pivot pin at one end and coupled to said swing rod at the other end; and a slip spring provided on said pivot pin and applying a compressive force on said lever such that said lever is frictionally held at some first angle relative to said pendulum and such that whenever a torque greater than predetermined magnitude is exerted on said lever, said lever rotates to and maintains a second angle relative to said pendulum, whereby said escapement executes accurate time keeping motions without substantial dependence on alignment of said clock mechanism with the vertical as defined by gravity by automatically compensating for misalignments.

2. A clock mechanism comprising:

a pendulum;

an escapement for controlling speed and regularity of said pendulum; and means for coupling said escapement and said pendulum and for driving said escapement in a symmetric, periodic movement regardless of the disposition of said pendulum and an escapement with respect to the vertical, said means including;

a swing member coupled to said pendulum and to support the weight of said pendulum about a pivot point, said swing member configured in the shape of a ring;

a lever rotatably coupled to said escapement, said lever extending from said ring of said swing member towards the interior of said ring, said lever further being rotatably coupled to said pendulum at some first angle relative to said pendulum such that whenever a torque greater than a predetermined magnitude is exerted on said lever, said lever rotates to and maintains a second angle relative to said pendulum, whereby said escapement executes accurate time keeping motions without substantial dependence on alignment of said clock mechanism with the vertical as defined by gravity by automatically compensating for misalignments.

* * * * *